US005267417A

United States Patent [19]

Rose

[11] Patent Number: 5,267,417

[45] Date of Patent: Dec. 7, 1993

[54] METHOD AND APPARATUS FOR REMOVING OUTER COATINGS FROM PIPE

[76] Inventor: James L. Rose, P.O. Box 681986, Houston, Tex. 77268

[21] Appl. No.: 895,725

[22] Filed: Jun. 9, 1992

Related U.S. Application Data

[60] Division of Ser. No. 743,989, Aug. 12, 1991, Pat. No. 5,199,226, which is a continuation of Ser. No. 646,499, Jan. 28, 1991, Pat. No. 5,107,633, which is a continuation-in-part of Ser. No. 470,819, Jan. 26, 1990, abandoned.

[51] Int. Cl.[5] ..... B24C 3/06; B24C 1/00

[52] U.S. Cl. ..... 51/429; 51/424; 51/426; 51/428; 51/319; 51/290

[58] Field of Search ..... 51/16, 317, 319-321, 51/410-411, 417, 419, 420, 424-426, 428-429; 118/72-73, 305, 307-316, 323, 326, DIG. 11, DIG. 13; 134/144, 151, 153, 157, 163, 172-175, 177, 180-181, 183, 198-200; 15/88, 104.03, 104.04

[56] References Cited

U.S. PATENT DOCUMENTS

| | | | |
|---|---|---|---|
| 1,815,573 | 7/1931 | McManis . | |
| 1,821,352 | 9/1931 | McManis . | |
| 2,302,196 | 11/1941 | Downs et al. . | |
| 2,460,989 | 2/1949 | Kraner . | |
| 2,621,446 | 12/1952 | Russell . | |
| 4,205,694 | 6/1980 | Thompson et al. . | |
| 4,552,594 | 11/1985 | van Voskuilen et al. . | |
| 4,603,516 | 8/1986 | Hoffman . | |
| 4,677,998 | 7/1987 | van Voskuilen et al. . | |
| 4,953,496 | 9/1990 | Taylor et al. . | |
| 5,052,423 | 10/1991 | Chapman et al. | 134/174 |
| 5,056,271 | 10/1991 | Rose | 51/429 X |
| 5,069,234 | 12/1991 | Nielsen . | |
| 5,074,323 | 12/1991 | Chapman et al. | 134/181 |
| 5,085,016 | 2/1992 | Rose | 118/72 X |
| 5,092,357 | 3/1992 | Chapman et al. . | |
| 5,107,633 | 4/1992 | Rose | 51/429 |
| 5,129,355 | 7/1992 | Taylor et al. | 118/323 X |

FOREIGN PATENT DOCUMENTS 0343878 11/1989 European Pat. Off. .

*Primary Examiner*—Bruce M. Kisliuk
*Assistant Examiner*—Bo Bounkong
*Attorney, Agent, or Firm*—Bush, Moseley & Riddle

[57] ABSTRACT

A coating removal machine or carriage (22) for a pipe (10) has an enclosed housing (44, 46, 48, 50) extending about front and rear tool carriers (74, 76) which rotate in opposite directions about the pipe (10) and have coating removal tools (116, 118, 120) for removing the coating material from the pipe (10). The removed coating material (12) is collected in removable bags (66) beneath the machine (22) for disposal at a separate remote disposal site. A dust collector (28) has a vacuum line (32) extending to the enclosed housing (44, 46, 48, 50) to remove minute coating particles which are suspended in air or air borne. One embodiment (FIGS. 10 and 11) is provided for a fixed installation. Another embodiment (FIGS. 13-15) includes water under pressure discharged from nozzles (63B) to remove the coated material (12) from the pipe (10).

11 Claims, 11 Drawing Sheets

METHOD AND APPARATUS FOR REMOVING OUTER COATINGS FROM PIPE

REFERENCE TO RELATED APPLICATIONS

This application is a divisional application of pending application Ser. No. 743,989 filed Aug. 12, 1991, U.S. Pat. No. 5,199,226 dated Apr. 6, 1993; which is a continuation in part of pending application Ser. No. 646,499 filed Jan. 28, 1991, U.S. Pat. No. 5,107,633 dated Apr. 28, 1992; which is a continuation in part of application Ser. No. 470,819 filed Jan. 26, 1990, abandoned.

FIELD OF THE INVENTION

This invention relates to a method and apparatus for removing outer coatings from pipe, and more particularly to such a method and apparatus for removing coatings from the outside of the pipe and then collecting the material removed from the pipe for disposal at a remote disposal site.

BACKGROUND OF THE INVENTION

Heretofore, self propelled apparatus has been provided, such as shown in U.S. Pat. No. 4,603,516 for cleaning the outside of pipe as the apparatus moves along a pipeline while supported thereon. Cleaning the outside of pipe removes loose rust, scale and dirt, to prepare the pipe for the subsequent application of a coating material on the outer surface of the pipe to minimize corrosion and prolong the service life of the pipe. In some instances, the pipe may be wrapped with an outer lining material containing an inner coating material for contacting the outer cleaned surface of the pipe. Normally abrasive particles, such as hard shot particles or grit, have been thrown by centrifugal force from an impeller wheel or the like against the outside of the pipe for cleaning the pipe. Particularly where hard shot particles of a uniform size were used previously, a relatively smooth clean outer surface of pipe was provided.

Oftentimes, a pipe coating removal device utilizing high pressure water is provided ahead of the so-called de-scaling apparatus so that the pipe coating, such as a bituminous layer, is first removed before the de-scaling operation by a separate cleaning device. For example, as shown in U.S. Pat. No. 4,552,594 dated Nov. 12, 1985, a carriage travelling along a pipeline discharges high pressure water from water jets or nozzles for removal of an outer coating on the pipe. The nozzles are positioned about the pipe for oscillation as the apparatus moves along the pipe thereby to clean the entire outer periphery of the pipe. An enclosed chamber or housing is normally provided on a travelling carriage of the pipe cleaning apparatus for maintaining the discharge water or grit in an enclosed volume about the pipe.

In the past, many pipelines were coated with materials that are not acceptable environmentally, such as coatings containing various percentages of certain materials, such as asbestos, fiberglass, or bituminous materials. Such materials must be disposed of in an approved manner, such as an approved remote disposal site. For this purpose, some provision must be made to collect the waste material from the cleaning or coating operation for removal to the remote disposal site.

SUMMARY OF THE INVENTION

The present invention is particularly adapted to a method and apparatus for the removal of coated materials from the outer surface of a pipe or pipeline which materials are not acceptable environmentally, such as asbestos, fiberglass, or bituminous materials and must be collected for separate disposal. The outer coating material is first removed from the outer surface of the pipe by a plurality of revolving cutter blades enclosed in a housing about the pipe. The waste material from the cleaning operation falls downwardly by gravity into a lower sump or well beneath the pipe and suitable lower discharge openings are provided in the housing for discharge of the waste material into removable containers, such as bags, for collection and transport to a suitable remote disposal site.

Minute particles from a potentially hazardous material, such as asbestos, oftentimes are suspended in air and do not fall by gravity to the bottom of the housing for discharge into bags or other removable containers. It is desirable to remove such air suspended health hazardous fine dustlike particles from the enclosed housing and for that purpose a vacuum line is connected to the enclosing housing from a dust collector on a skid being pulled alongside the pipe by a side boom tractor or the like. Thus, the air suspended potentially harmful particles are collected in a container or collector for separate disposal.

In one embodiment, the cleaning or coating removal device or carriage is easily positioned on the pipe for movement along the pipe and may be easily removed from the pipe when desired. The carriage includes an upper supporting section having rollers for contacting the pipe, and a pair of side sections pivotally mounted to the upper supporting section for folding about the pipe after the carriage is lowered onto the pipe. The carriage is self propelled along the pipe by drive means rotating at least one of the rollers. Such an arrangement is particularly adapted for cleaning a continuous pipeline raised from the ditch or trench in which the pipeline is positioned for cleaning and is returned after recoating.

In another embodiment, the coating removal apparatus is provided at a fixed installation and individual pipe sections or lengths are moved through the apparatus for removal of the coating. The coating removal operation and removal means are similar for both embodiments, in the first embodiment the apparatus moves relative to the pipe and in the second embodiment the pipe moves relative to the coating removal apparatus.

These embodiments of the invention by utilizing a plurality of cutting blades for removing the coated material provide a so-called dry cleaning system without using water or abrasive particles in a pressurized air stream for discharge from nozzles against the coated material for removal of the coated material from the pipe. While the knives or blades for removing the coated material might not function adequately in a precise time period for certain coatings, such as a polyethylene type coating, it has been found to be entirely satisfactory for the removal of coatings containing asbestos including bituminous coatings and various types of fiber coatings. It has also been found desirable in certain instances to wet the coating before removal thereof so that the particles fall downwardly by gravity for collection instead by being suspended in air. A water vapor may be sprayed by nozzles in a mist-like stream on the coating before the removal tools engage the coating and may, if desired, be sprayed onto the particles during the removal operation.

A third embodiment has also been provided in which the coating is removed from the pipe at a fixed installation by a high pressure liquid at a pressure between 5,000 and 40,000 psi. In all embodiments, however, the coating is removed within an enclosed housing and the removed coating particles are collected for disposal at a separate disposal site.

It is an object of the present invention to provide a method and apparatus for the removal of environmentally unacceptable coated materials from the outer surface of a pipeline or pipe sections with the removed coating particles being collected for disposal at a separate remote approved disposal site.

It is a further object of this invention to provide such a method and apparatus in which the coated material is removed from the pipe within an enclosing housing containing oscillating or rotatable removal means with the removed coating particles being collected in removable bags adjacent the housing for disposal at a remote approved disposal site.

Another object of the invention is the provision of such a method and apparatus in which air suspended or air borne finely divided or dustlike particles from the coated materials are removed from an enclosed housing by a vacuum to a dust collector while heavier particles drop by gravity through a lower discharge opening in the housing into a removable bag or container.

Other objects, features, and advantages of this invention will become more apparent after referring to the following specification and drawings.

DESCRIPTION OF THE INVENTION

Figure 1:
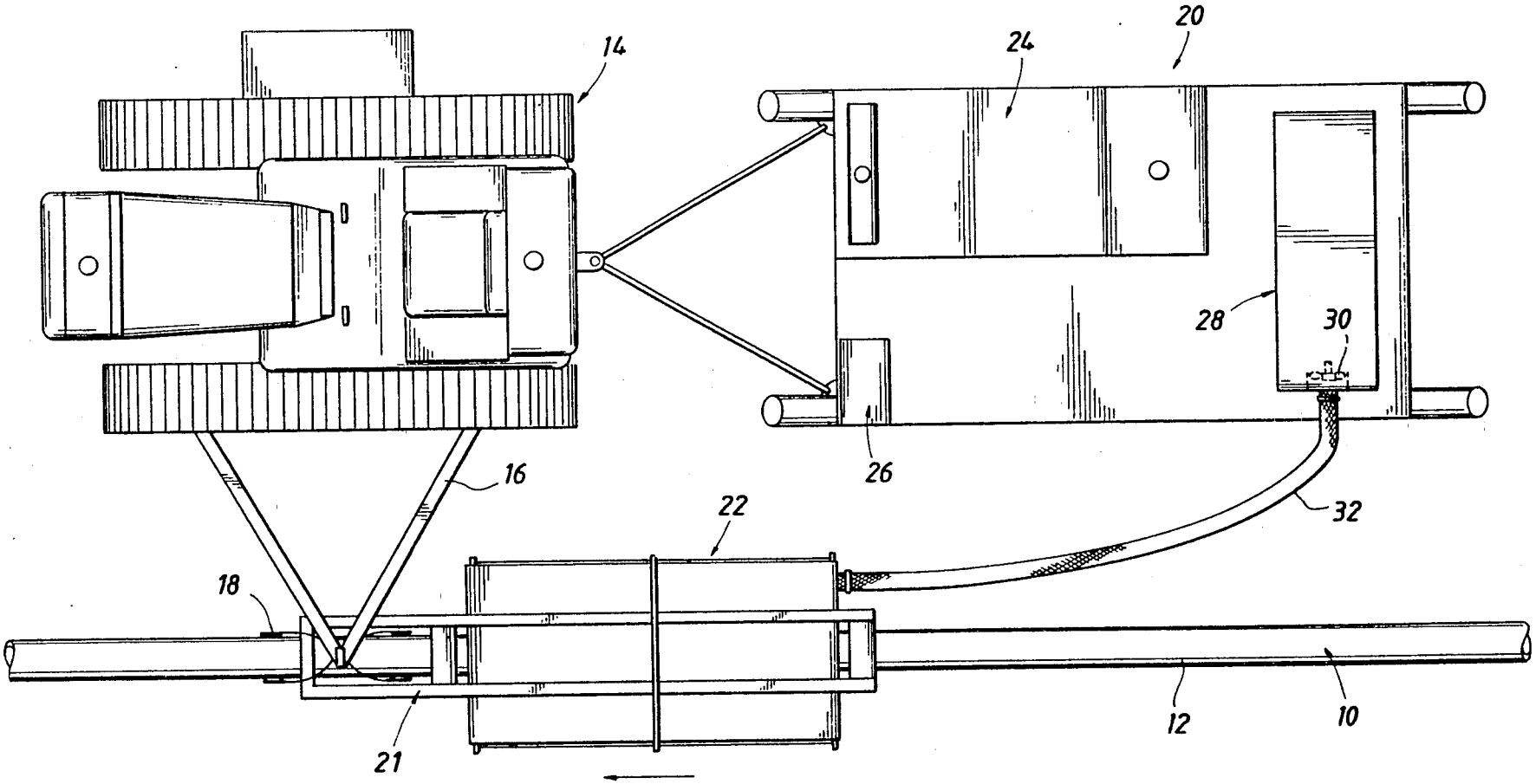
FIG. 1 is a plan, partly schematic, of the apparatus comprising the present invention for removing an outer coating from a pipe including means for collecting the material removed from the pipe.
Figure 2:
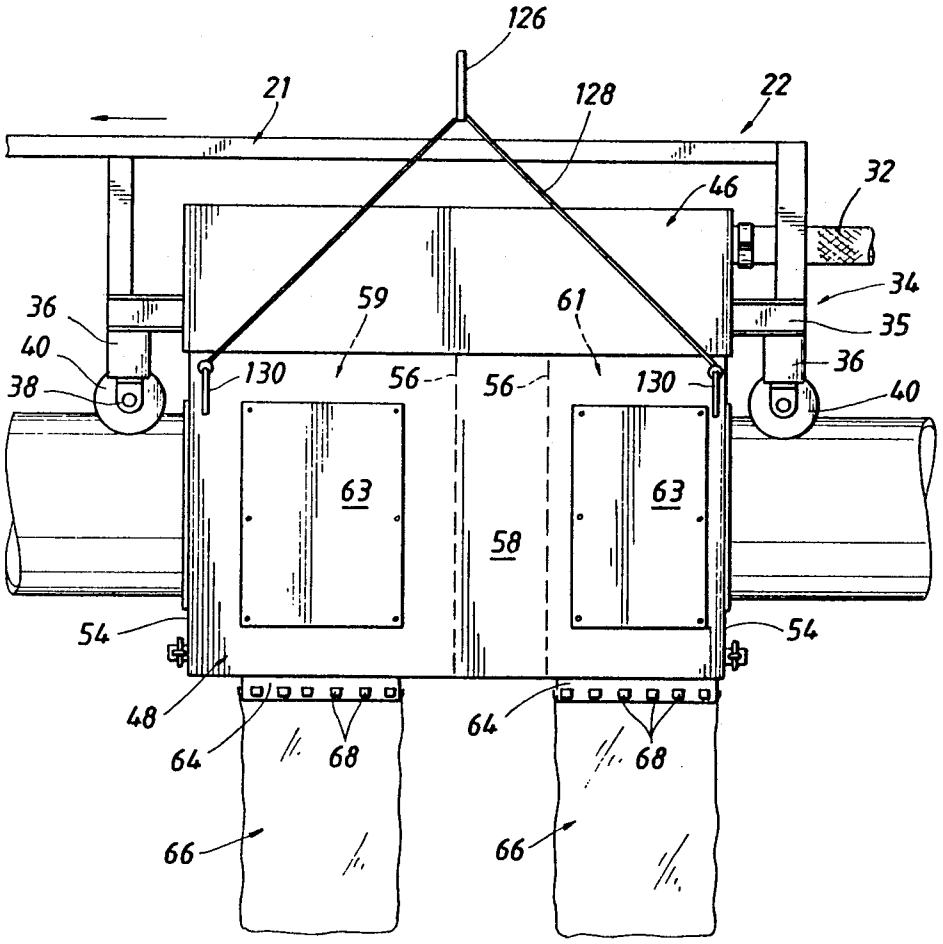
FIG. 2 is a side elevation of a carriage for moving along the pipe and including an outer housing about the pipe with means removably connected beneath the housing for collecting coating material removed from the pipe.
Figure 3:
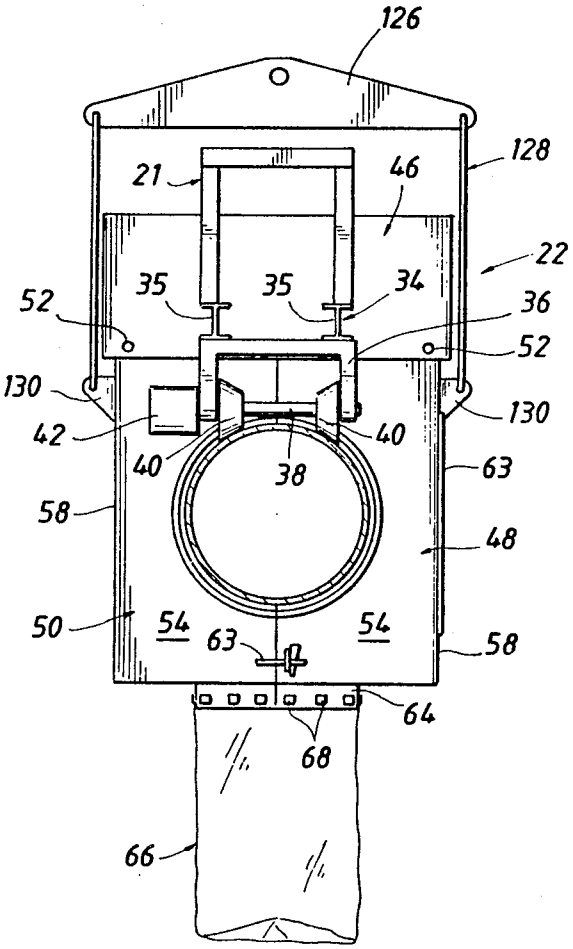
FIG. 3 is a rear elevation of the carriage shown in FIG. 2 showing the enclosed housing about the pipe and means supporting the carriage for movement along the pipe.

Referring now to the embodiment of the invention shown in FIGS. 1-9, an apparatus is illustrated for removing the coating material from a pipe while the apparatus moves along the pipe. As shown in FIG. 1, a pipe or pipeline is shown generally at 10 and has an outer coating material 12 thereon of around ¼-½ inch in thickness, for example. Coating material 12 includes a material therein, such as asbestos or a bituminous material, and upon removal from pipe 10 is collected for disposal at a remote disposal site approved for possible hazardous materials. Pipe 10 is lifted from a ditch or trench in which it has been positioned and a front side boom tractor shown at 14 has a side boom 16 supporting a roller pipe support 18 having rollers thereon for supporting the lower surface of pipe 10 above the ground. After removal of the coating and application of a new coating, pipe 10 is returned to the ditch and covered with soil and/or gravel.

Tractor 14 pulls a skid or trailer generally indicated at 20 alongside pipe 10 and skid 20 contains the supplies and power sources for operating the coating removal machine shown generally at 22 supported on pipe 10. Skid 20 has a hydraulic power unit illustrated at 24, a control panel at 26, and a dust collector 28. Hydraulic power unit 24 includes a drive means and reservoir for a hydraulic pump supplying hydraulic fluid to various hydraulic motors as will be explained further. Dust collector 28 has an associated centrifugal fan shown at 30 to exert a vacuum through a flexible conduit or hose 32 leading from coating removal machine 22. A suitable hydraulic motor (not shown) may drive centrifugal fan 30. An overhead frame 21 is connected to coating removal machine 22 and insures that pipe 10 is supported by roller support 18 at a predetermined distance from machine 22.

Figure 4:
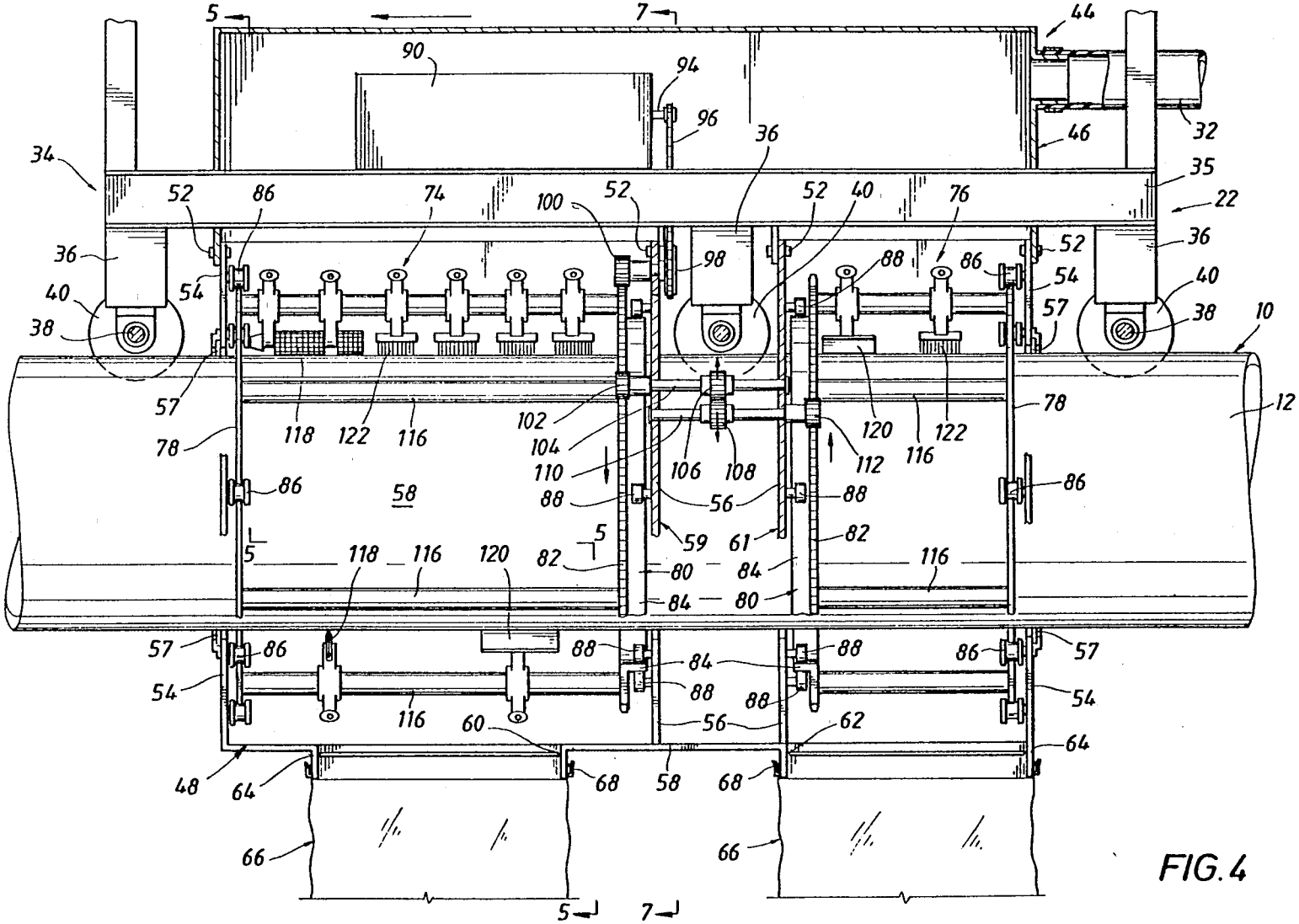
FIG. 4 is a sectional view showing the oppositely rotating tool carriers having removal tools thereon for removing the outer coating from the pipe.

Coating removal machine or carriage 22 as shown particularly in FIGS. 2-5 is self propelled for moving along pipe 10 and includes an upper support frame generally indicated 34 having horizontal frame members 35 and downwardly extending roller support brackets 36 each supporting a roller axle 38 with rollers 40 thereon. Overhead frame 21 is secured to upper support frame 34. A hydraulic motor 42 is provided for driving front rollers 40 to propel carriage 22 along pipe 10. Upper support frame 34 supports an enclosed housing generally indicated at 44. Housing 44 comprises an upper housing section 46 fixed to upper frame 34 and a pair of lower housing sections 48, 50 mounted for pivotal movement about pivot axes 52 on upper fixed housing section 46. Lower housing sections or lower housing halves 48, 50 each comprises a lower housing half extending longitudinally of pipe 10 and adapted to fit about 180 degrees of pipe 10. Each housing half 48, 50 includes parallel end plates 54 and intermediate plates 56 connected by a peripheral wall 58. Intermediate plates 56 separate front and rear housing portions 59 and 61. Removable panels 63 are connected to wall 58 of section 48 to permit access to the interior of front and rear housing portions 59 and 61 as may be necessary for servicing or repair of the coating removal apparatus. Housing sections 48, 50 are releasably connected to each other by latches 63 in closed position about pipe 10 in an operable position for operation of coating removal machine 22. Upper fixed housing section 46 and lower split housing sections 48, 50 form an enclosed housing about pipe 10 and an elastomeric seal 57 carried by housing sections 48, 50 engages the outer surface of pipe 10 to provide a generally air-tight relation as shown in FIG. 4.

The lower portion of peripheral wall 58 has a pair of discharge openings 60, 62 therein and a downwardly extending peripheral flange 64 about each of discharge openings 60, 62. As shown particularly in FIG. 9, a removable bag or container generally indicated at 66 has an open upper end fitting about flange 64 and releasable clip members 68 have ends 70 spring urged into gripping contact with bag 66. A removable closure plate is shown at 72 to close opening 62 as might be desirable for removal of bag 66 when filled with particles of coating material removed from pipe 10. Closure plate 72 fits within a suitable slot in flange 64 and may be removed or inserted manually. Bag 66 when filled with particles of coated material may be transported to an approved remote disposal site for hazardous material in the event the removed coating material may be harmful to the environment.

Figure 5:
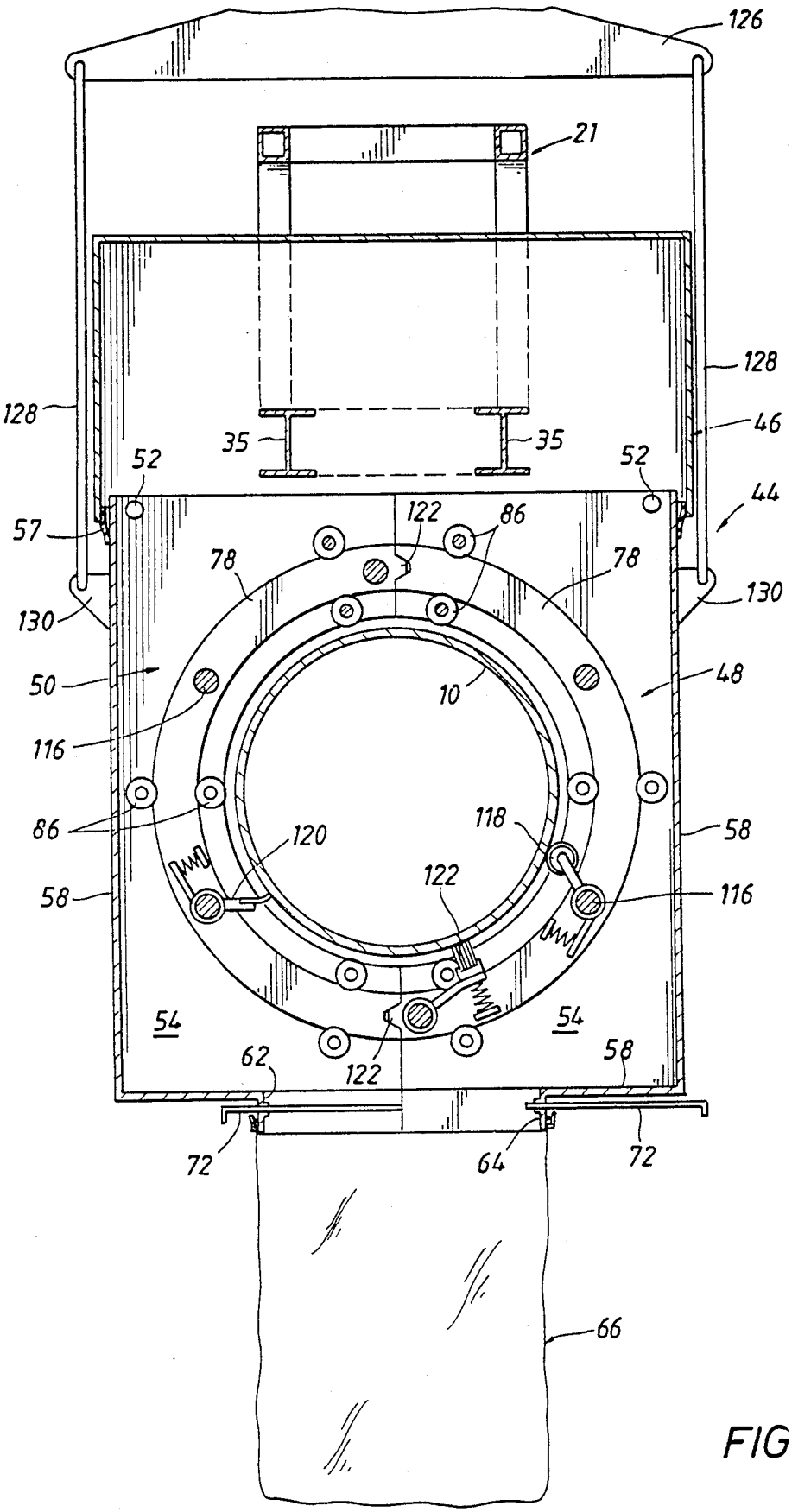
FIG. 5 is a transverse section taken generally along line 5—5 of FIG. 4 and showing the removal tools contacting the outer surface of the pipe for removing the coating and means to pivot the lower housing sections to an open position.

For removing the coating material 12 from the outer surfaces of pipe 10 a pair of tool carrying holders or carriers indicated generally at 74 and 76 are enclosed within the housing formed by fixed upper housing section 46 and lower pivoted housing sections 48 and 50 as shown particularly in FIGS. 4 and 5. Front tool carrier 74 is mounted for rotation in one direction about pipe 10 and rear tool carrier 76 is mounted for rotation about pipe 10 in an opposite direction. Each tool carrier 74, 76 has an annular outer end 78 and an annular inner end 80. Annular inner end 80 includes a ring gear 82 and a laterally extending flange or rim 84 extending outwardly from the outer side of ring gear 82. Grooved rollers 86 are secured to end plates 54 of housing sections 48, 50 adjacent opposed edges of annular ends 78 and support annular ends 78 thereon for relative rotation. Rollers 88 are secured to ends 56 of housing sections 48, 50 adjacent opposed sides of flanges 84 and flanges 84 are supported by rollers 88 for relative rotation as shown particularly in FIG. 4.

For rotating tool carriers 74, 76 in opposite directions about pipe 10, a hydraulic motor shown generally at 90 is mounted on horizontal frame members 35 within housing section 46 and has suitable fluid lines 92 leading thereto from power unit 24 on skid 20. An output drive shaft 94 drives a sprocket 96 extending about sprocket wheel 98 for rotating drive gear 100 in engagement with teeth on ring gear 82 of front tool carrier 74 to rotate tool carrier 74 as shown in FIG. 4. Ring gear 82 of front tool carrier 74 engages a spur gear 102 to rotate shaft 104 and spur gear 106. Gear 106 engages gear 108 on countershaft 110 which has a spur gear 112 on its end engaging ring gear 82 of rear tool carrier 76 in driving relation to rotate rear tool carrier 76 in a direction opposite the rotational direction of front tool carrier 74. A spring tensioned idler roller 114 engages sprocket 96 to maintain sprocket 96 in a taut relation and to permit pivoting of housing sections 48, 50 as shown in FIG. 8, for example.

Connecting shafts or rods 116 extend between ring gears 82 and annular outer ends 78. Coating removal tools are mounted on selected shafts 116 including cutting tools 118, scraping tools 120, and wire brushing tools 122. Tools 118, 120, 122 are spring urged into engagement with the outer surface of pipe 10 to remove the coating material 12 from pipe 10. Tool carriers 74 and 76 rotating in opposite directions and having coating removal tools 116, 118, and 120 thereon have been utilized heretofore for the removal of coatings or scales from pipe such as illustrated by a model "C" cleaning machine manufactured by CRC Cross, Tulsa, Okla.

Figure 6:
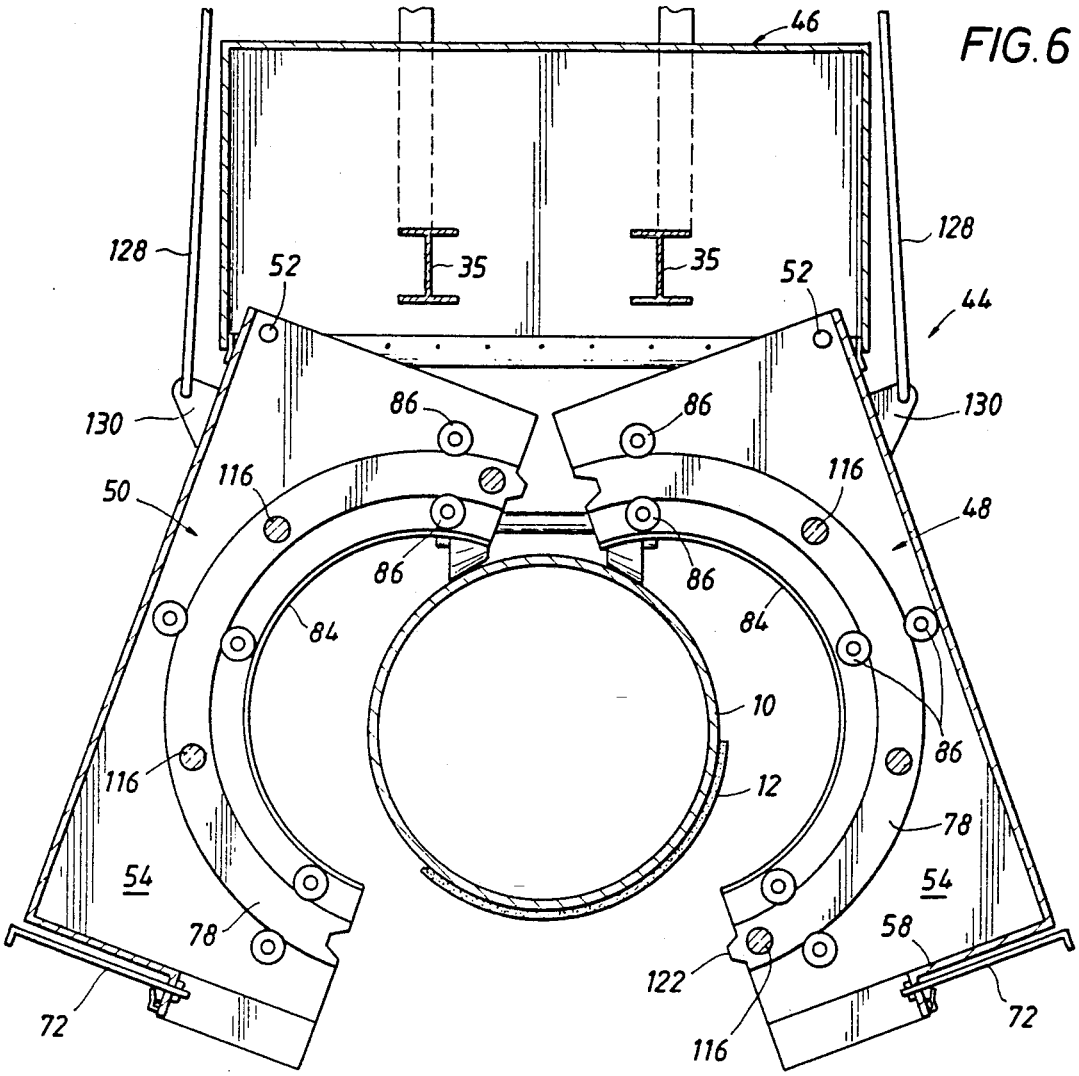
FIG. 6 is a sectional view similar to FIG. 5 but showing the lower housing sections pivoted to a partially open position.
Figure 9:
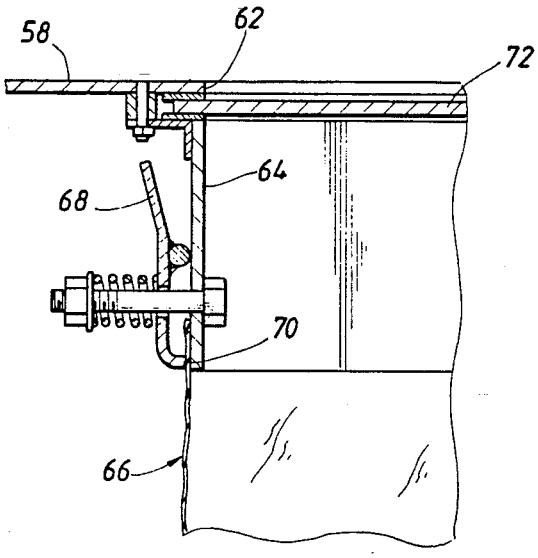
FIG. 9 is an enlarged partial sectional view of the means for detachably securing a bag beneath a lower discharge opening in the housing for collecting the material removed from the pipe for subsequent removal to a remote disposal site.
Figure 7:
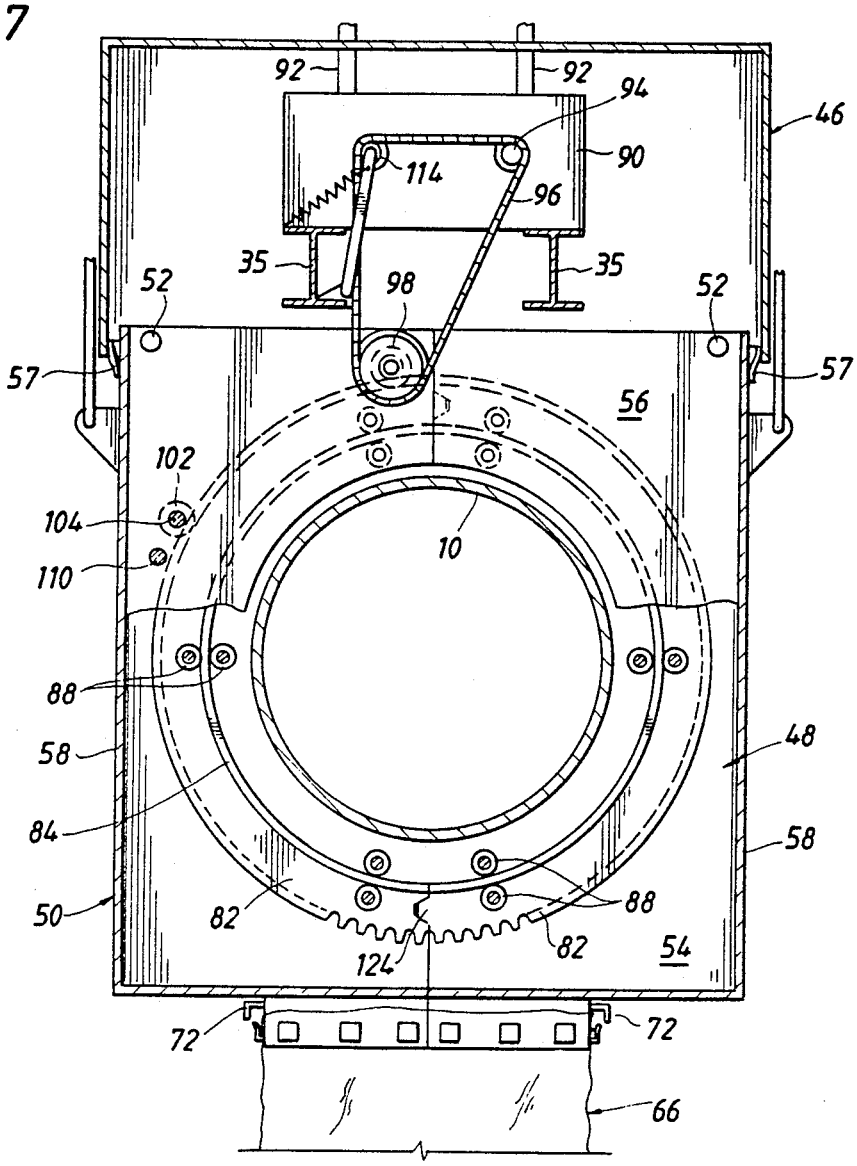
FIG. 7 is a sectional view taken generally along line 7—7 of FIG. 4 and showing means for rotating the tool carriers relative to the enclosed housing.
Figure 8:
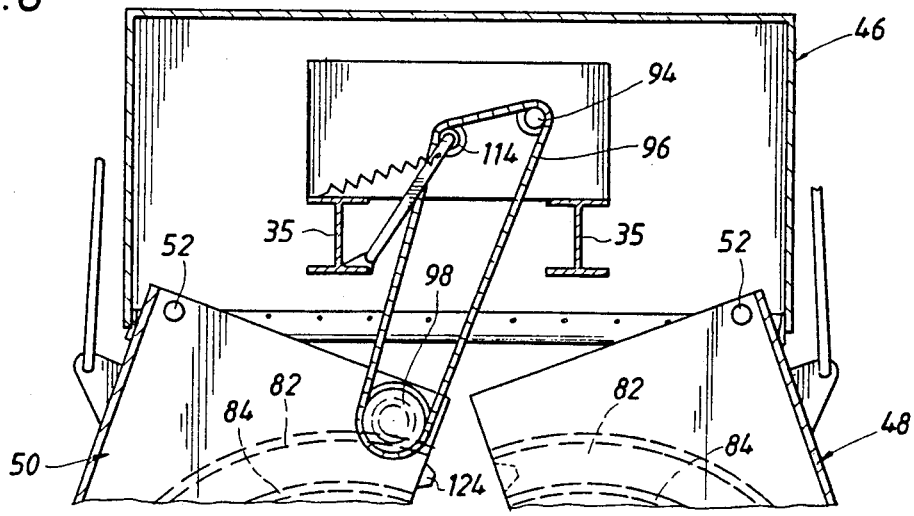
FIG. 8 is an enlarged fragment of FIG. 7 showing the drive means in a position with the lower housing sections pivoted to a partially open position.

Referring now particularly to FIGS. 5–8, means for lifting coating removal machine 22 from pipe 10 and for pivoting housing sections 48 and 50 to an open position are illustrated. FIGS. 5 and 6 shown annular end 78 formed of two interfitted sections on housing sections 48, 50 and having an interfitting tongue and groove connection 122 for alignment. FIGS. 7 and 8 show ring gear 82 and extending flange 84 formed of two interfitting sections on housing sections 48, 50 and having an interfitting tongue and groove connection 124 for alignment. Housing sections 48 and 50 when latched together by latches 63 in closed position about pipe 10 have rollers 86, 88 in engagement with end plates 78 and ring gears 82 to hold the sections of end plates 78 and the sections of ring gears 82 in tight interfitting relation.

For lifting coating removal machine 22 from pipe 10 and for positioning machine 22 onto pipe 10, a lifting bar or beam 126 has an eye which may be engaged by a cable from tractor 14 or a crane. The ends of lift bar 126 have connecting members 128 connected to lift lugs 130 on housing sections 48, 50. Upon unlatching of latches 63 and upward movement of lift bar 126, housing sections 48, 50 pivot outwardly about pivots 52 relative to upper frame 36 until housing sections 48, 50 contact upper fixed housing section 46 as shown in FIG. 6. Further upward movement of lift bar 126 results in lifting of the entire machine 22 from pipe 10. A reverse order is utilized for the initial positioning of machine 22 onto pipe 10.

In operation, coating removal machine or carriage 22 is positioned on pipe 10 as indicated in FIG. 1 with tractor 14 supporting pipe 10 above the ground and pulling a skid 20 alongside pipe 10. Hydraulic fluid is supplied to hydraulic motor 42 and hydraulic motor 90 from power unit 24 thereby to propel carriage 22 along pipe 10 and to rotate tool carriers 74 and 76 in opposite directions about pipe 10 with coating removal tools 118, 120, 122 engaging the outer surface of pipe 10 to remove coating 12. Vacuum pump or centrifugal fan 30 for dust collector 28 is driven from a hydraulic motor and a vacuum is exerted through line 32 to upper housing section 46. Coating particles upon removal from pipe 10 fall downwardly by gravity through discharge openings 60, 62 into the collecting bags or containers 66. Upon filling of bags 66, closure plates 72 are inserted across discharge openings 60, 62 and bags 66 removed for separate transportation to a remote disposal site. Minute coating particles may be suspended in air or air borne and these particles are removed through vacuum line 32 to dust collector 28 by the vacuum exerted by vacuum line 32. The coating particles in dust collector 28 are likewise collected for disposal at a remote disposal site.

Tool carriers or holders 74 and 76 may be rotated at a speed of around 150 rpm for a pipe having a diameter of 18 inches for example. Coating removal machine 22 moves along pipe 10 at a rate between around 15 to 25 feet per hour for pipes having a diameter between around 12 inches and 30 inches in diameter.

After removal of the coating from the pipe, it is normally desired to recoat the pipe with a suitable coating and then return the pipe to the trench or ditch from which the pipe was removed. Such a coating machine may easily follow the coating removal machine 22.

Figure 10:
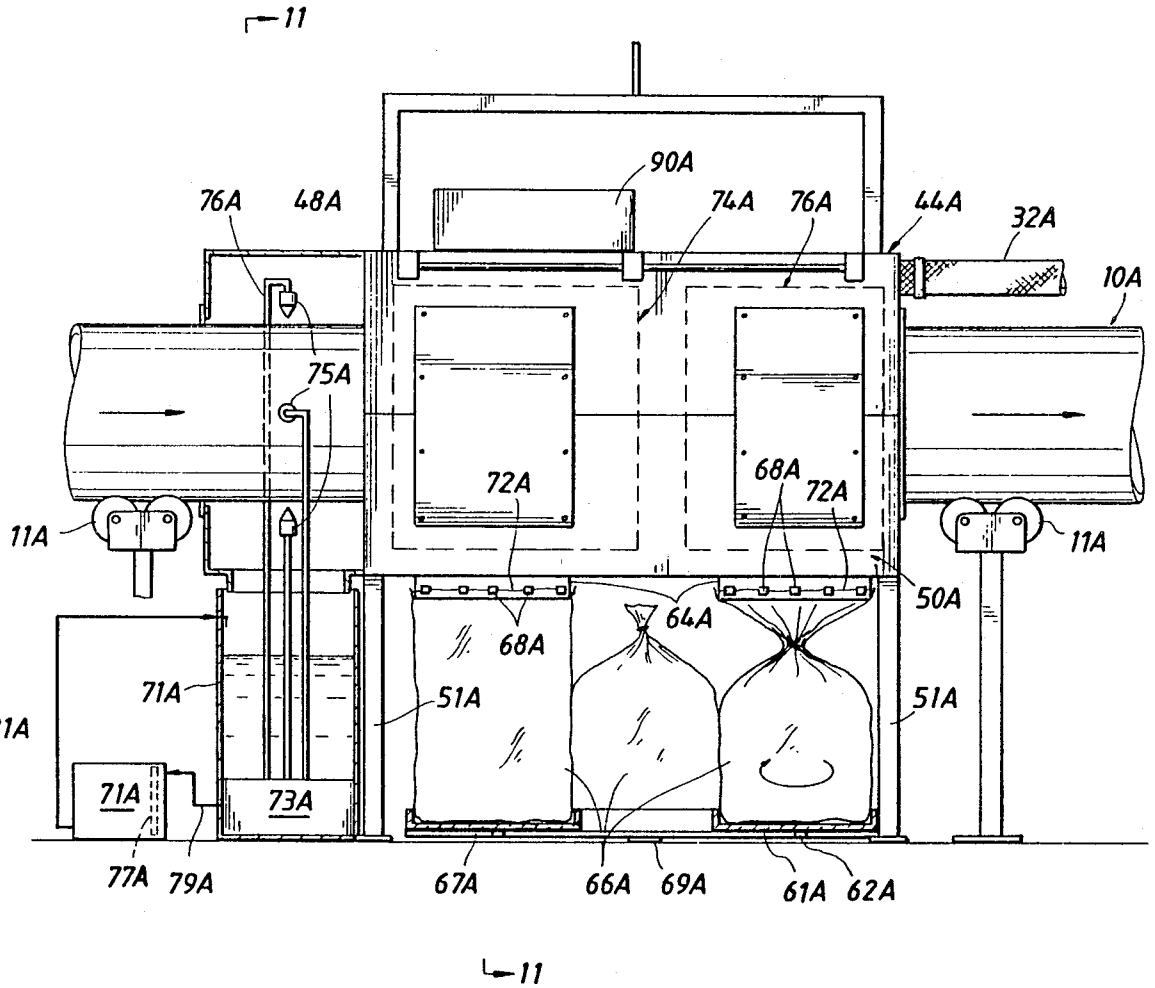
FIG. 10 is a side elevation of another embodiment of this invention in which the apparatus for removing the coating from the pipe at a fixed installation as pipe sections with the coating thereon are moved through the cleaning apparatus.
Figure 11:
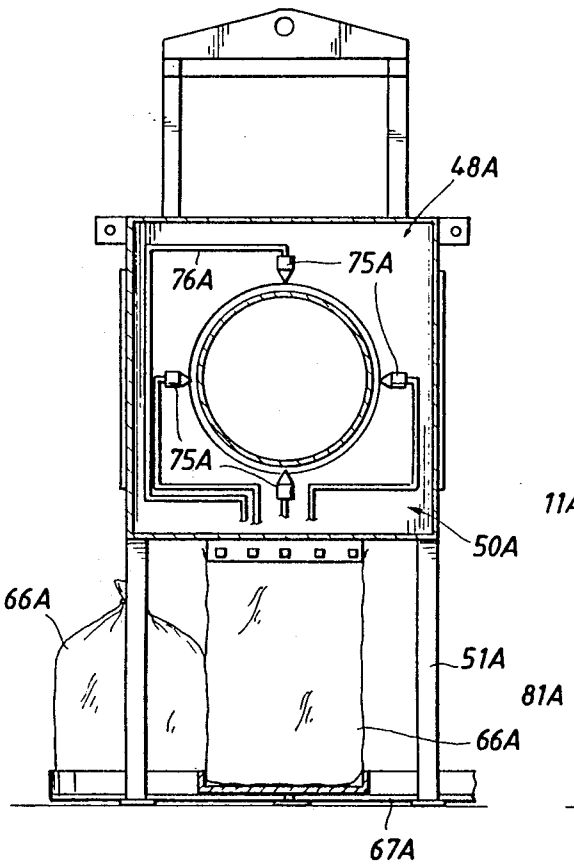
FIG. 11 is an end elevation of the embodiment of the invention shown in FIG. 10 showing the removal apparatus having extended legs for supporting the apparatus on a supporting surface at the fixed installation.

Under certain conditions, it may be desirable to remove an outer coating from pipe sections or lengths not in situ or in place within a trench and for that purpose a modified coating removal machine 22A is shown in FIGS. 10 and 11 at a fixed installation. Pipe section 10A is supported at opposed ends by drive rollers 11A which feed or move pipe 10A through enclosed housing 44A of coating removal machine 22A. Upper and lower housing sections 48A and 50A are connected to each other about pipe 10A to form enclosed housing 44A and lower housing section 50A has extendible support legs 51A for contacting a supporting surface. A hydraulic motor 90A is provided for rotating tool carriers 74A, 76A similar to the embodiment of FIGS. 1–9. Collecting bags 66A for the removed coating particles are provided. A rotatable base or "lazy susan" 67A is mounted beneath bags 66A for selective rotation about pivot 69A. Mounted on pivots 62A on base 67A are four separate rotatable supports 61A each having a bag 66A thereon. As shown in FIG. 10, a loaded bag 66A may be rotated by support 61A to twist and close bag 66A. Then a suitable band can be placed about the closed portion of the bag and the bag then released by clips 68A. In this manner, a person unloading bags 66A would not be exposed to the removed coating particles during unloading. Base 67A may be rotated to facilitate removal of the filled bags 66A for separate transport to an approved disposal site. Base 67A has four positions thereon for bags 66A and two empty bags 66A may be rotated by base 67A beneath flanges 64A for securement by releasable clips 68A. Removable closure plates 72A are provided for the discharge openings and the discharge openings are closed upon removal and installation of bags 66A.

It may be desirable to wet the coating before removal thereof particularly if the coating is friable and tends to crumble when removed. For that purpose a water tank or reservoir 71A having a water pump 73A therein driven by a suitable hydraulic motor supplies water through lines 74A to nozzles 75A which are spaced at 90° intervals about the periphery of pipe 10A. Nozzles 75A are positioned around 12–18 inches from the outer surface of the pipe and have small diameter discharge orifices for discharging of water in a mist-like vapor for wetting the coating. Each nozzle 75A covers about 100° of the periphery of pipe 10A thereby to provide an overlap between adjacent nozzles 75A. By wetting the coating prior to removal thereof, the air borne particles are minimized. Only a small amount of water is recycled and a filter 77A is provided to receive water from inlet line 79A and to return filtered water to tank 71A through outlet line 81A. Under some conditions with a relatively thick friable coating such as ⅝ inch in thickness, it may be desirable to provide additional spray nozzles 75A within enclosed housing 22A adjacent tool carriers 74A and 76A and such additional nozzles 75A may be connected by suitable clips to the inside of housing 22A.

A vacuum line 32A extends to a suitable dust collector as in the embodiment of FIGS. 1–9 and exerts a vacuum inside housing 44A to draw air borne coating particles from the inside of housing 44A to the dust collector. The particles are filtered by the dust collector and are collected for disposal at a remote disposal site. A thin polyethylene sheet is preferably placed under the entire coating removal apparatus to collect any loose material falling on the ground.

It may be desirable to add a similar wetting attachment to the embodiment of FIGS. 1–9. In that event, the water tank and filter may be supported on skid 20 with suitable supply lines extending to spray nozzles within an enclosed housing extending about pipe 10 and connected to front end wall 54 of housing 44. In this manner, the coating is wetted before removal thereof by tool carriers. The remaining features of the embodiment of FIGS. 10 and 11 are generally similar to the features of the embodiment of FIGS. 1–9 except in regard to means for propelling the coating removal machine.

Figure 12:
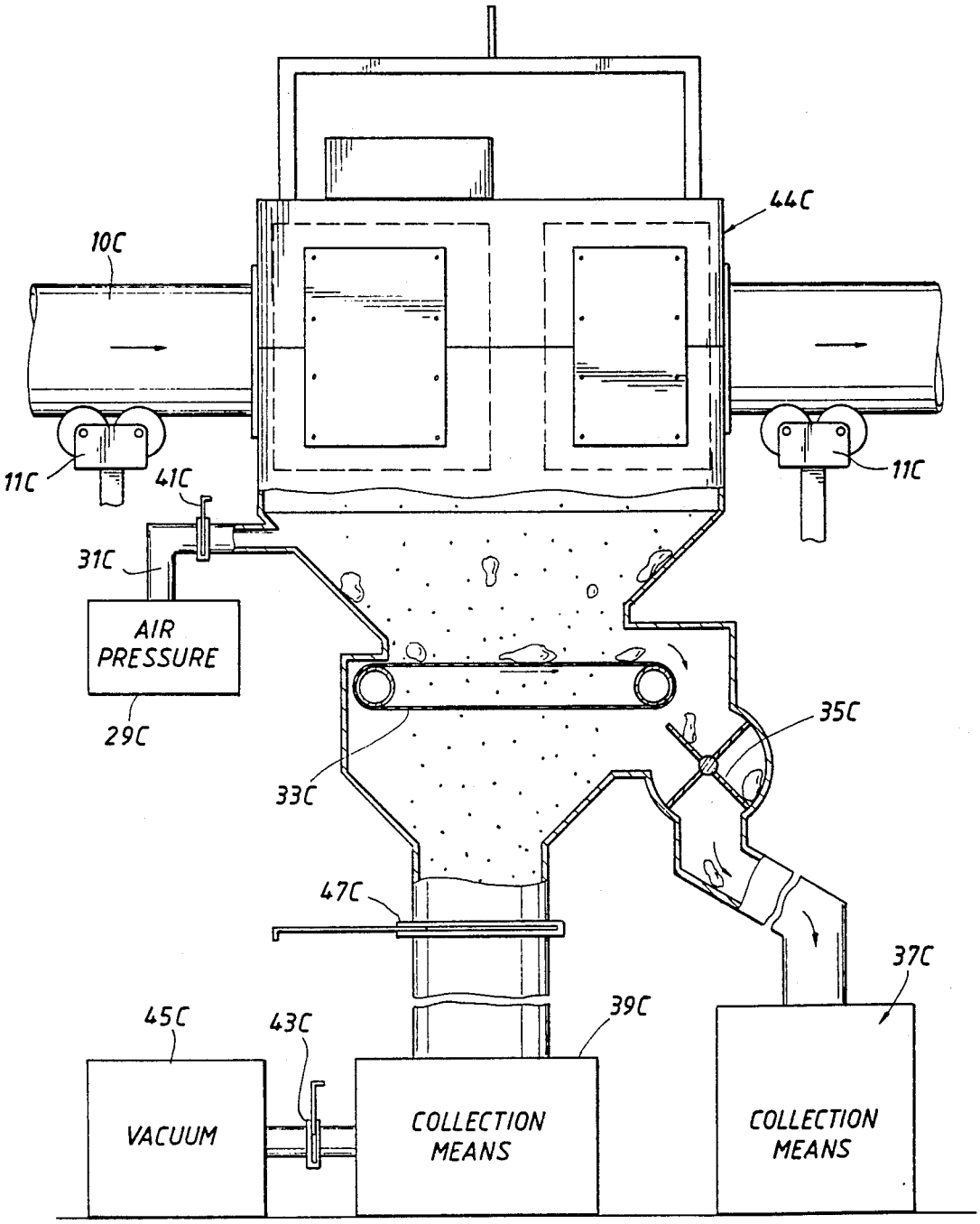
FIG. 12 is a side elevation of a further embodiment of coating removal apparatus at a fixed installation illustrating a conduit for conveying the removed coating particles from the enclosed housing to a separate collecting means by vacuum or by pressurized air.

Under certain conditions, it may be desirable to convey all of the coating particles from the enclosed housing in a pressurized air stream or vacuum in a conduit to a separate collector such as a dust collector. As shown in a further embodiment in FIG. 12, housing 44C has pipe 10C moving therethrough on drive rollers 11C for cleaning. If desired to remove the coating particles in a pressurized air stream, pressurized air from an air source such as an air compressor 29C is supplied through conduit 31C to enclosed housing 44C. The coating particles fall downwardly and a rotating screen 33C of a predetermined mesh restrains large coating particles for removal through an air lock formed by impeller 35C for discharge in a suitable container at 37C. The smaller coating particles pass screen 33C and are entrained in the air stream to a suitable container at 39C for transport to a remote site. If desired, a vibratory screen may be utilized in lieu of rotating screen 33C.

If it is desired to unload by vacuum, a gate 41C may be closed to block the air flow from air source 29C and a gate 43C opened to exert a vacuum from vacuum means at 45C. A gate 47C may be closed if desired to block flow to collection means 39C. The cleaning apparatus for removing the coating from pipe 10C is similar to that utilized in the embodiments of FIGS. 1–11. A filter at the collection means shown at 37C, 39C may be utilized to collect the coating particles for subsequent packing or collection in bags or the like for transportation to a remote disposal site. Such an arrangement would remove personnel at enclosed housing 44A from possible contamination in the event of possible damage to collecting bags since the collection means are spaced from the enclosed housing.

Figure 13:
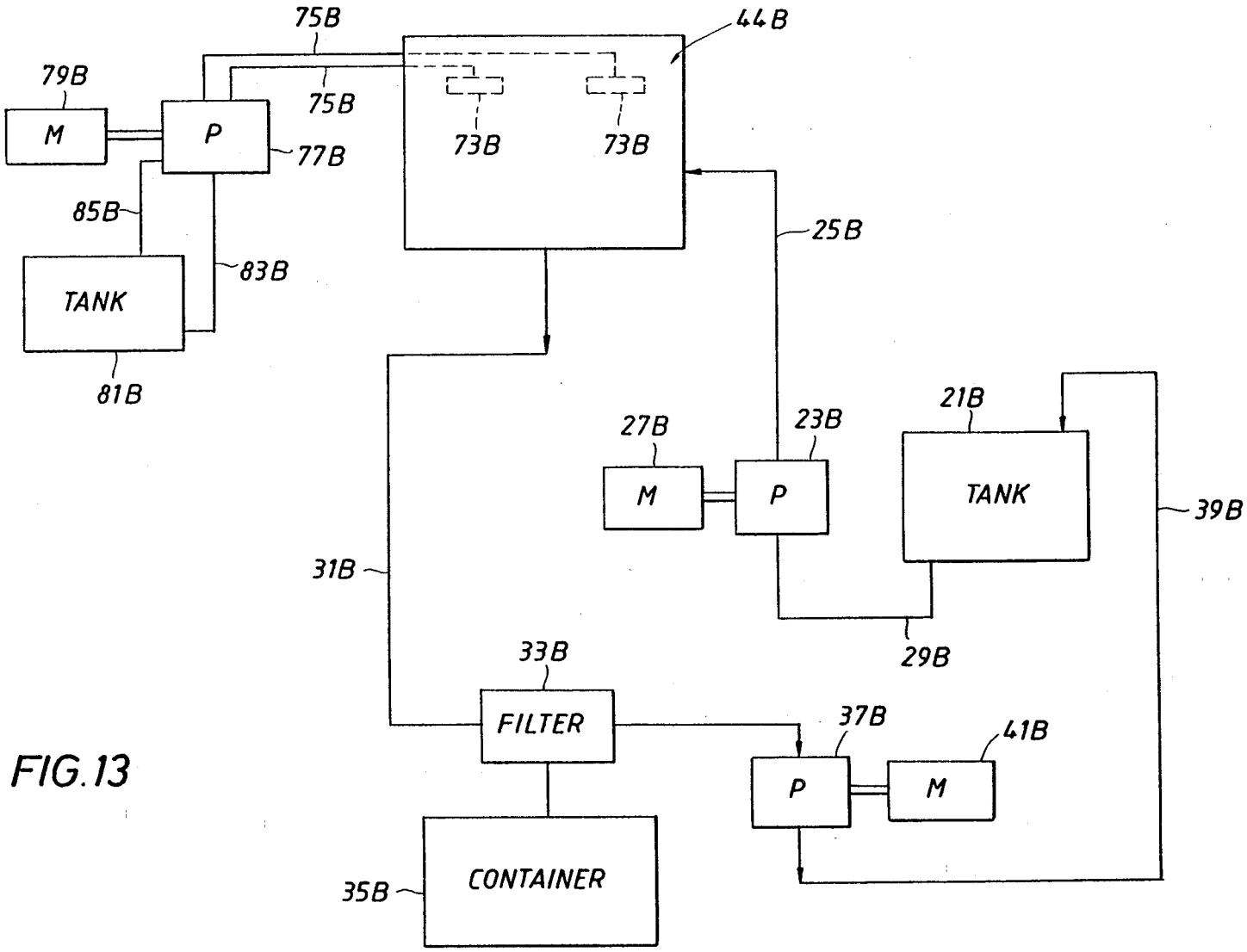
FIG. 13 is a schematic of another embodiment of coating removal apparatus in which pressurized water discharged from nozzles is utilized for the removal of the coating.
Figure 14:
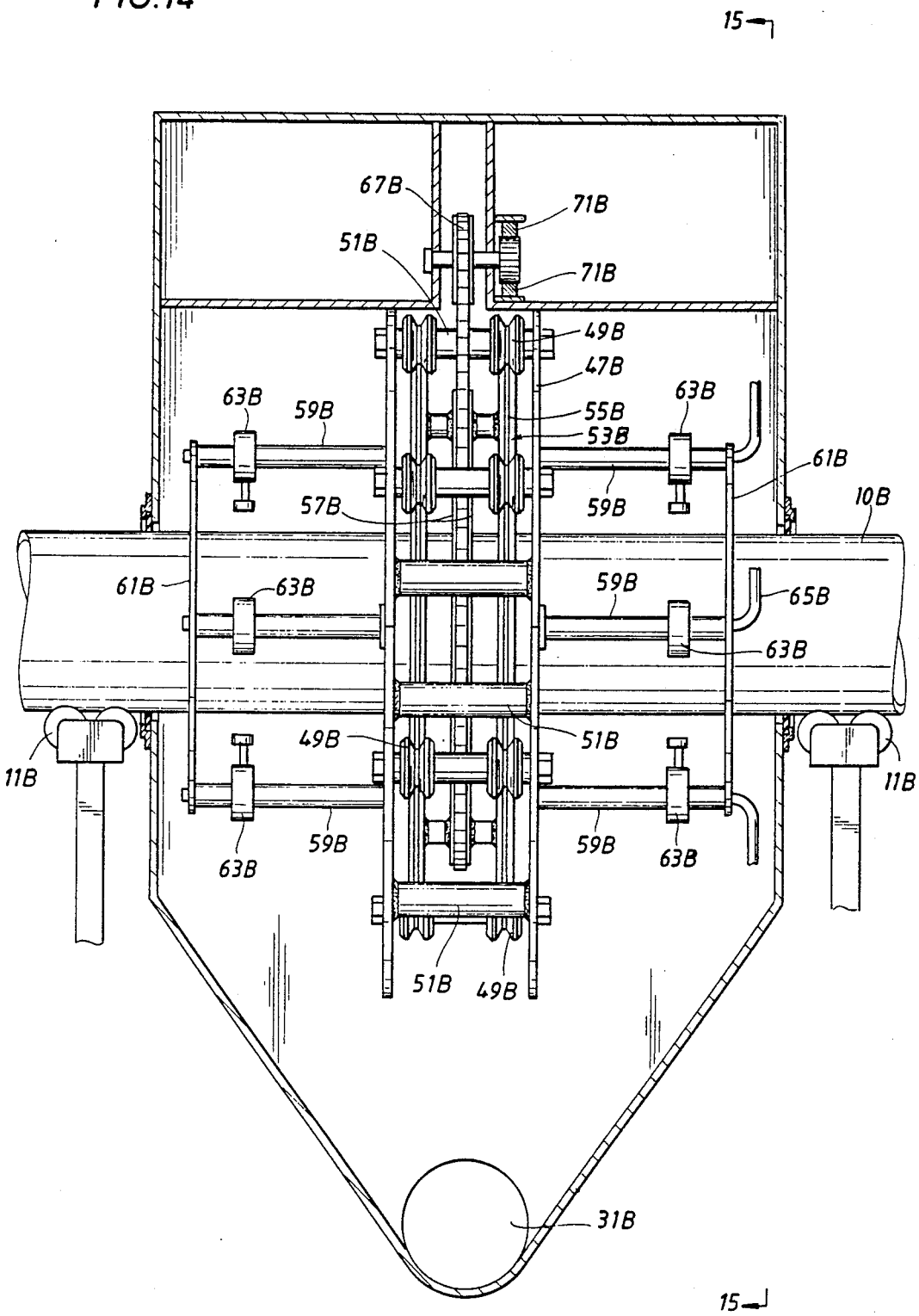
FIG. 14 is a side elevation of the enclosed housing of the coating removal apparatus containing the nozzles for removal of the coating.
Figure 15:
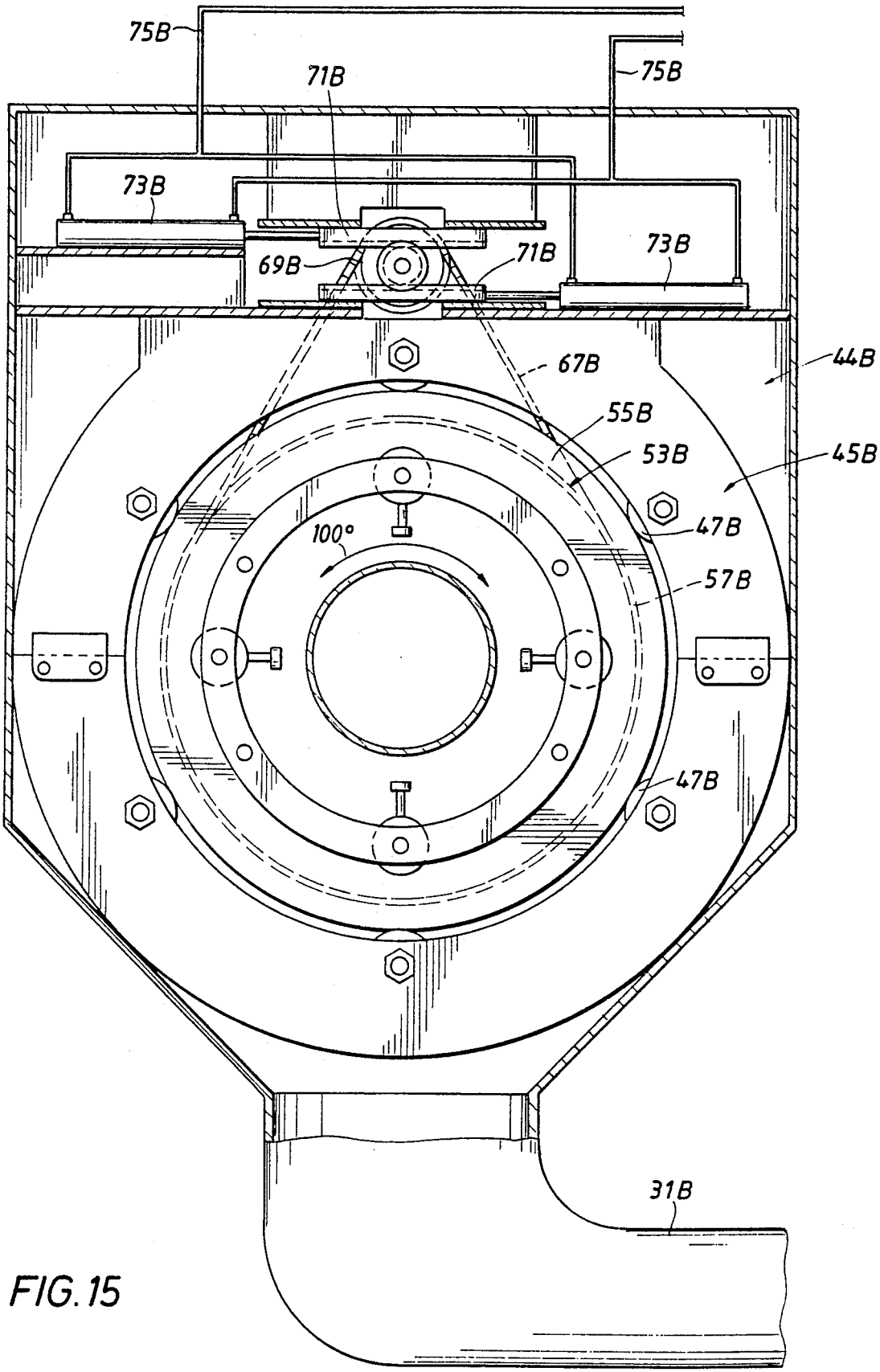
FIG. 15 is a section taken generally along line 15—15 of FIG. 14.

Referring now to another embodiment of this invention in FIGS. 13–15, a coating removal machine 22B is shown at a fixed installation for the removal of coatings from pipe sections or lengths by a high pressure liquid such as water. Referring first to FIG. 13 in which the coating removal system is shown schematically, an enclosed housing is shown generally at 44B including a pair of end members with openings to receive the pipe and a peripheral wall secured between the end members about the pipe for containing the liquid coating removal means illustrated in FIGS. 13 and 14. Water is supplied to the coating removal means from a water tank or reservoir 21B by pump 23B and inlet line 25B. A hydraulic motor 27B drives pump 23B and a return line 29B is provided to water reservoir 21B. Water and entrained coating particles are discharged from outlet line 31B into a filter 33B. The coating particles are collected in suitable bags or containers at 35B for transportation to a remote disposal site. The water is returned to reservoir 21B by pump 37B and return line 39B. A suitable hydraulic motor 41B is provided for driving pump 37B.

Referring to FIGS. 14 and 15, pipe 10B is moved by supporting drive rollers 11B through housing 44B at a predetermined speed. An outer fixed annular frame generally indicated at 45B has end ring members 47B mounting rollers 49B for rotation about shafts 51B extending between ring members 47B. Mounted for oscillation on rollers 49B is an inner oscillating frame generally indicated at 53B. Inner frame 53B includes a pair of spaced plates 55B supported on rollers 49B and carrying inner plates 57B having outer toothed circumferences.

Water pipes or tubes 59B are secured to each plate 55B and extend outwardly therefrom. An outer ring 61B is mounted on the outer ends of water pipes 59B. A water spray nozzle 63B is mounted on each pipe 59B and a flexible supply hose or line 65B is connected to each pipe 59B. Supply lines 65B are connected to main supply line 25B for the supply of pressurized water from tank or reservoir 21B. Nozzles 63B are positioned at arcuate intervals of 90° about the circumference of pipe 10B and are spaced about 12 to 18 inches from pipe 10B. It is desirable to oscillate nozzles 63B around 90°–100° in order to be effective in the removal of the coating by water pressurized from around 5,000 to 40,000 psi upon discharge from nozzles 63B.

For oscillating inner frame 53B and nozzles 63B in an arcuate path concentric to the outer surface of pipe 10B a chain 67B fits about the outer toothed circumference of plates 57B, and over a drive pinion 69B. Racks 71B engage pinion 69B and double acting hydraulic cylinders 73B are provided for the reciprocation of racks 71B. Hydraulic fluid is supplied to cylinders 73B through lines 75B from pump 77B as shown in FIG. 13. Pump 77B is driven by hydraulic motor 79B and receives fluid from reservoir 81B through supply line 83B. A fluid return line is shown at 85B. The removed coating particles are entrained in water and flow through discharge line 31B to filter 33B where the coating particles are collected at 35B in suitable containers for transport to a remote disposal site. The filtered water is returned to housing 44B.

It is apparent that various means may be provided for oscillating inner frame 53B. For example, a reversible motor actuated by limit switches contacted by inner frame 53B might be utilized in reversing the rotation of inner frame 53B. Also, while the several embodiments shown have been illustrated for use with coatings formed of hazardous materials, it is apparent that the present apparatus and method may be utilized with other non-hazardous coatings. In some instances, the removed coating material may be discharged back into the trench or ditch from which the pipe was removed and then covered with adjacent soil or the like.

While preferred embodiments of the present invention have been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. Apparatus for removing a coating material from the outer surface of a pipe and comprising:

an enclosed housing extending about said pipe having a pair of spaced end members with aligned openings to receive the pipe and having a discharge opening therein;

a plurality of nozzles within said housing spaced about the outer circumference of said pipe for discharge of a pressurized liquid against the outer surface of the pipe;

means to supply pressurized liquid to said nozzles;

coating collecting means connected to said discharge opening to collect the waste coating material for disposal at a remote disposal site, said coating collecting means including a filter for filtering the entrained waste coating particles from the water and container means for collecting the filtered coating particles for separate transport to a remote disposal site;

an outer fixed frame mounted within said enclosed housing and having a central opening therein;

an inner frame positioned concentrically within the central opening of said outer fixed frame and having said nozzles mounted thereon; and means to oscillate said inner frame and nozzles thereon back and forth relative to said outer frame and said pipe.

2. Apparatus as set forth in claim 1 wherein rollers are mounted between said inner and outer frames to support said inner frame for oscillating movement.

3. Apparatus as set forth in claim 1 wherein a chain is connected to said inner frame for oscillating said inner frame.

4. Apparatus as set forth in claim 3 wherein a rack and pinion combination is operatively connected to said chain for oscillating said inner frame.

5. Apparatus for removing a coating material from the outer surface of a pipe comprising:

an enclosed housing extending about said pipe having a pair of spaced end members with aligned openings to receive the pipe and a peripheral wall secured between said end members about said pipe and having a lower portion with a discharge opening therein;

an outer fixed support frame mounted within the housing about the pipe;

an inner frame supported concentrically on said outer frame;

a plurality of nozzles on said inner frame within said housing spaced at equal arcuate intervals about the outer circumference of said pipe for discharge of pressurized water against the outer surface of the pipe;

means to supply pressurized water to said nozzles;

means to oscillate said inner frame and nozzles thereon relative to said outer frame back and forth in an arcuate path concentric to the outer surface of said pipe;

collecting means connected to said discharge opening to receive water and waste coating material from said discharge opening for removal from said housing, said collecting means including means to separate water from said waste material; and means to return water separated from said waste coating material to said nozzles for recirculation.

6. Apparatus as set forth in claim 5 wherein said means to separate water from said waste material includes a filter and a container associated with said filter to collect the waste coating material separated from the water.

7. Apparatus as set forth in claim 5 wherein said means to return water to said nozzles includes a water reservoir and a pump to pressurize the water for return to said nozzles.

8. Apparatus for removing a coating material from the outer surface of a pipe by high pressure water comprising:

an outer fixed support frame mounted about the pipe and having a central opening therein;

an inner nozzle mounting frame supported concentrically on said support frame and having a plurality of discharge nozzles therein spaced at equal arcuate intervals about the outer surface of the pipe for the discharge of pressurized water against the pipe;

means between said outer support frame and said inner nozzle mounting frame for oscillating said nozzle mounting frame and nozzles thereon relative to said outer support frame in a predetermined arcuate path concentric to the outer periphery of said pipe so that pressurized water from the discharge nozzles is directed against the entire outer circumference of the pipe;

an enclosed housing extending about said pipe and discharge nozzles, said housing including a pair of spaced end members with aligned openings to receive the pipe and a peripheral wall secured between said end members about said pipe and having a bottom with a discharge opening therein;

means to supply pressurized water to said nozzles for discharge against the outer surface of the pipe;

separation means connected to said discharge opening to receive water and waste coating material from said discharge opening for removal from said housing and to separate said waste coating material from said water; and means to pressurize the separated water and return the separated water to said nozzles for the continuous recirculation of the water.

9. A method of removing a coating material from the outer surface of a pipe by high pressure water directed against the pipe;

providing an enclosed housing about the pipe including a pair of spaced end members with openings to receive the pipe and a peripheral wall secured between the end members about the pipe with a discharge opening in the bottom of said housing;

providing an outer support frame within said enclosed housing;

providing an inner frame positioned concentrically within the outer frame and supported thereon;

providing a plurality of nozzles on said inner frame within said enclosed housing spaced at equal arcuate intervals about the periphery of said pipe;

supplying pressurized water to said nozzles for discharge against the outer surface of said pipe for removal of the coating material;

oscillating said inner frame and the nozzles thereon relative to said outer support frame in such a manner that the entire outer circumference of the pipe is contacted by high pressure water from the nozzles for removing the coating material;

conveying the water and waste coating material from said discharge opening in the bottom of said housing to a separation means;

separating the water from the waste coating material at said separation means; and returning the separated water from the separation means to the discharge nozzle for a recirculation of the water.

10. Apparatus for removing a coating material from the outer surface of a pipe and comprising:

an enclosed housing extending about said pipe having a pair of spaced end members with aligned openings to receive the pipe;

a plurality of nozzles within said housing spaced about the outer circumference of said pipe for discharge of a pressurized liquid against the outer surface of the pipe;

means to supply pressurized liquid to said nozzles;

an outer fixed frame mounted within said enclosed housing and having a central opening therein for receiving the pipe;

an inner frame supported concentrically on said outer fixed frame and having said nozzles mounted thereon; and means to oscillate said inner frame and nozzles thereon back and forth relative to said outer fixed frame and said pipe.

11. A method for removing a coating material from the outer surface of a pipe;

providing an enclosed housing about the pipe including a pair of spaced end plates with openings to receive the pipe and a peripheral wall secured between the end plates about the pipe;

providing an outer fixed frame within the enclosed housing;

providing an inner frame supported concentrically on said outer fixed frame;

providing a plurality of nozzles on said inner frame within said enclosed housing about the periphery of said pipe;

supplying pressurized water to said nozzles for discharge against the outer surface of said pipe; and providing means for oscillating said inner frame and nozzles thereon back and forth relative to said outer fixed frame and pipe in a direction generally concentric to the outer surface of said pipe.

* * * * *